US006881045B2

(12) United States Patent
Zitka et al.

(10) Patent No.: US 6,881,045 B2
(45) Date of Patent: Apr. 19, 2005

(54) PROGRESSIVE CAVITY PUMP/MOTOR

(75) Inventors: Mark D. Zitka, The Woodlands, TX (US); William D. Murray, Tomball, TX (US)

(73) Assignee: Robbins & Myers Energy Systems, L.P., Houston, TX (US)

( * ) Notice: Subject to any disclaimer, the term of this patent is extended or adjusted under 35 U.S.C. 154(b) by 0 days.

(21) Appl. No.: 10/465,458

(22) Filed: Jun. 19, 2003

(65) Prior Publication Data

US 2004/0258548 A1 Dec. 23, 2004

(51) Int. Cl.[7] ..... F03C 2/08; F04C 2/107
(52) U.S. Cl. ..... 418/48; 418/153; 418/178
(58) Field of Search ..... 418/48, 153, 178; 418/ 264/267, 269; 29/888.023; 425/468

(56) References Cited

U.S. PATENT DOCUMENTS

| | | | | |
|---|---|---|---|---|
| 1,892,217 A | | 12/1932 | Moineau | 418/48 |
| 3,084,631 A | | 4/1963 | Bourke | 418/48 |
| 4,104,009 A | | 8/1978 | Chanton | 418/48 |
| 4,339,406 A | * | 7/1982 | Underwood | 264/267 |
| 4,676,725 A | | 6/1987 | Eppink | 418/48 |
| 5,171,138 A | | 12/1992 | Forrest | 418/48 |
| 5,759,019 A | | 6/1998 | Wood et al. | 418/48 |
| 6,183,226 B1 | | 2/2001 | Wood et al. | 418/48 |
| 6,309,195 B1 | | 10/2001 | Bottos et al. | |
| 6,336,796 B1 | | 1/2002 | Cholet et al. | |
| 6,358,027 B1 | * | 3/2002 | Lane | 418/48 |

FOREIGN PATENT DOCUMENTS

| | | | |
|---|---|---|---|
| DE | 279043 | * | 5/1990 |
| DE | 4111166 | * | 10/1992 |
| RU | 400689 | * | 10/1973 |
| RU | 412367 | * | 1/1974 |
| WO | WO 01/44615 A2 | | 10/2000 |

* cited by examiner

*Primary Examiner*—John J. Vrablik
(74) *Attorney, Agent, or Firm*—Browning Bushman

(57) ABSTRACT

A progressive cavity pump or motor, particularly suitable for hydrocarbon recovery operations, includes a rotor 20 and a stator 10. Fluid pressure in cavities between the stator and the rotor create torque which rotates the bit. An interior surface of the stator is rigidly secured to the outer housing of the pump stator and defines an interior profile. A substantially uniform thickness elastomeric layer 62 is supported on the outer housing. The pump rotor has an exterior profile which corresponds with the interior profile of the elastomeric layer.

20 Claims, 10 Drawing Sheets

PROGRESSIVE CAVITY PUMP/MOTOR

FIELD OF THE INVENTION

This invention relates to the design and manufacture of pumps and motors utilizing progressive cavity power sections. More specifically, this invention relates to the design and manufacture of the female stator component of the progressive cavity pump or motor.

BACKGROUND OF THE INVENTION

U.S. Pat. No. 1,892,217 discloses a gear mechanism of a progressive cavity pump or motor. This progressive cavity technology is commonly used in a pump to convert mechanical to power fluid energy, and in a motor to convert fluid energy to mechanical power. As a downhole motor, the moving energy of a drilling fluid may be converted to rotary motion to rotate a bit to drill a subterranean well. Other publications of interest including U.S. Pat. Nos. 3,084,631; 4,104,009; 4,676,725; 5,171,138; 5,759,019; 6,183,226; 6,309,195; and 6,336,796; and WO 01/44615.

Operation of a progressive cavity pump or motor utilizes an interference between the external profile of the rotor which resides inside the stator, and the internal profile of the stator. This interference allows the cavities of the pump or motor to be sealed from adjoining cavities. This seal resists the fluid pressure resulting from the mechanical pumping action, or resulting from the conversion of fluid energy to mechanical energy in a motor. This interference between the internal rotor and stator necessitates that one of or both of these components be covered with a resilient or dimensionally forgiving material which also allows the pump or motor to pass or transfer particles and other abrasive objects in either the driving fluid (motor) or the transmitted fluid (pump). Historically, this resilient material has been provided on the interior of the stator.

The resilient material used for the stator introduces weaknesses into the operation and life of the pump/motor. Common elastomers have temperature tolerances below that of most other components in the pump or motor, e.g., metal components. Mechanical resistance of the elastomer is also of concern since high pressures are generated in the cavities of the pump/motor. These high fluid pressures and the necessary reactive forces result in significant deflection and stress in the elastomer, particularly along the rotor/stator interferences. These forces create friction which generates a large amount of heat during operation, and this heat may be very deleterious to the desired characteristics of the elastomer, and thus deleterious to the performance and life of the pump/motor.

A progressive cavity pump or motor stator is conventionally constructed by molding an elastomer with the desired spiral interior profile within a cylindrical steel tube or housing. Due to the spiral profile on the stator's inner surface, varying thicknesses of elastomer are molded between the stator inner surface and the inner surface of the metal tube to which the stator is adhered. If the heat resulting from the previously mentioned sources becomes excessive, the properties of the elastomer will more generally degrade. Elastomers have high insulative properties and thus inherently restrict the conduction of the heat generated at the rotor and stator interface from being conducted to the thermally conductive metal tube, which may then be dissipated from the pump/motor, if desired, with various cooling systems, including liquid cooling systems and exposed fin systems. The radially thicker sections of elastomer create the greater insulative properties, and thus typically degrade faster than radially thin sections. Additionally, the high pressure experienced during operation may deflect the thicker sections of elastomer to the extent that the interference is overcome and contact with the rotor is lost. This loss of contact results in decreasing speeds for the motor and decreasing flows for the pump, resulting in poor efficiency. In addition, heat from the pump/motor operation, in some cases in conjunction with the environment in which pump/motor operates, distorts the shape of the elastomer molded to the interior of the metal tube. Elastomers have a high coefficient of thermal expansion compared to other materials used in the construction of progressive cavity pump/motor. As a result of the varying thicknesses and the relatively high thermal expansion of the elastomer, the radially thick sections distort more than the thinner sections of the stator, which results in a geometrical profile drastically different than intended, thereby hindering the proper operation of the pump/motor. This distorted profile may generate additional heat and further distort the stator profile, creating a system which rapidly contributes to its own degradation and ultimate failure.

During operation, a conventional downhole progressive cavity drill motor develops a great deal of heat due to the friction between the rotor and the stator. In addition, the flexing of the rubber profile generates heat which must be removed from the motor to prevent the elastomeric material portion of the stator from being detrimentally effected. Heat generated may be transferred to the fluid being pumped through the motor. Alternatively, the heat may be conducted through the elastomer to the stator tube or housing where the thermally conductive steel tube then conducts heat to the drilling fluid moving along the exterior of the housing. Due to the high insulative properties of elastomeric material, heat generated along the radially thick portion of the stator profile is inhibited from effectively transferring to the thermally conductive steel tube. The center of the stator profile lobes is subjected to heat from a large percentage of its surrounding area and is the most limited in transferring this heat to the metal tube due to the thickness of the elastomeric material. With extended operation, the center of the stator profile lobes may become hard and brittle as a result of the excessive heat in this area, and the mechanical properties of the rubber or elastomer in this area are accordingly severely degraded. As a result, the stator lobe may break or "chunk out" of the stator profile. In addition, the pressure acting in the chambers between the stator and the rotor may exceed the strength of the elastomeric material, and the stator lobe may deflect from its original shape or may break or "chunk off" the stator lobe. A deflecting stator lobe degrades the pressure seal for the chambers created between the rotor and the stator.

The disadvantages of the prior art are overcome by the present invention. An improved progressive cavity pump/motor is hereinafter disclosed which overcomes many of the problems of prior art pumps and motors, including excessive build-up. The motor of a present invention is particularly well suited for use as the downhole motor in a well to rotate a bit.

SUMMARY OF THE INVENTION

The present invention relates to the design and manufacture of a stator for a progressive cavity pump or motor. In one embodiment, the stator includes a substantially uniform layer of elastomer on the interior of the stator profile. This uniform layer of elastomer has significant advantages, and overcomes many of the disadvantages of prior art progressive cavity pumps and motors. Alternatively, the elastomer layer may deviate from a uniform thickness to achieve desirable properties known to those skilled in the art.

To create the layer of elastomer on the interior of the stator profile, a profiled reinforcement member may be mounted to the interior of the cylindrical tube or housing. The reinforcement preferably has a profile substantially similar to but radially larger than that of the elastomeric lining. A layer of elastomeric material may then be molded to the interior of the reinforcement to create the desired stator.

In an alternate embodiment, a stator tube may include an inner stator member cast or molded into the tube. The inner surface of the inner stator member may have a slight taper which matches the taper on the generally tubular stator tube.

It is a feature of the invention that the interior surface which defines the interior profile of the pump stator may be integral with the outer housing, such that the elastomeric layer is formed on an interior profile of the outer housing. In an additional alternative embodiment, the interior profile of the stator tube may be integral with respect to the outer housing. In both embodiments, the elastomeric layer is formed on the interior of the resulting housing.

It is a further feature of the invention that the rubber layer may have an increasing thickness or taper extending along the axial length of the stator, such that a radial thickness of a first end of the elastomeric layer is less than the radial thickness of an opposing second end of the elastomeric layer.

In an alternate embodiment, the inner profile has a varying diameter, such that the radial thickness of an first end of the elastomeric layer is less than the radial thickness of a second end of the elastomeric layer.

A stator alignment feature is also disclosed, along with tooling which may be used during alignment and positioning to manufacture and repair the stator. Tooling may also be used to accurately verify the lead of any interior profiled stator tube.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
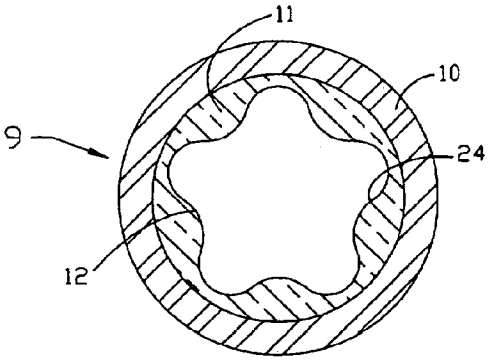
FIG. 1 is a transverse cross-sectional view of a conventional progressive cavity stator.
Figure 2:
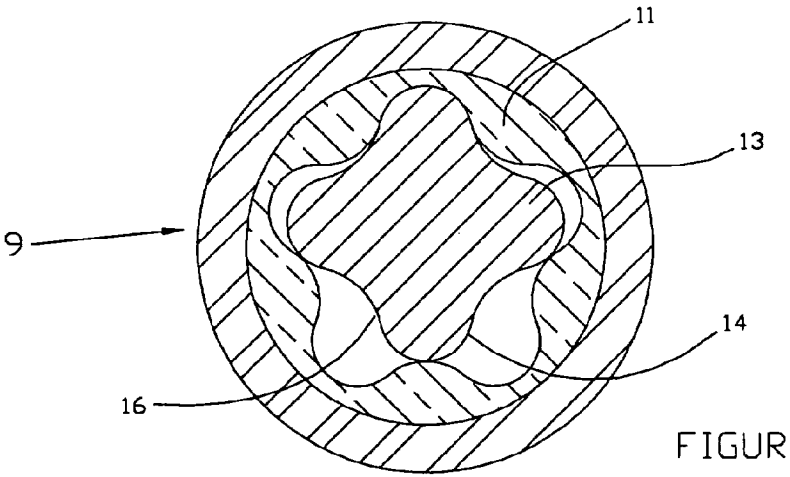
FIG. 2 is a transverse cross-sectional view of a conventional progressive cavity stator incorporating a rotor.

FIG. 1 depicts a conventional progressive cavity stator 9 of a pump or motor which includes a steel or similar structural material tube or housing 10. Elastomeric layer 11 is molded into the tube 10. The number of lobes 12 may be of any practical number greater than one. As can be seen in FIG. 2, the rotor 13 has one less lobe 14 than the mating stator. The number of lobes depends on the desired operating characteristics of the pump or motor. As the rotor 13 rotates inside of the stator 9, debris entrained in the fluid which supplies the energy for a motor, or is being moved by a pump, may become caught between the rotor surface 16 and the stator surface 24. The flexible nature of an elastomeric material allows this debris to be pressed into the stator surface 24, thereby allowing the rotor 13 to continue rotating unabated.

Figure 3:
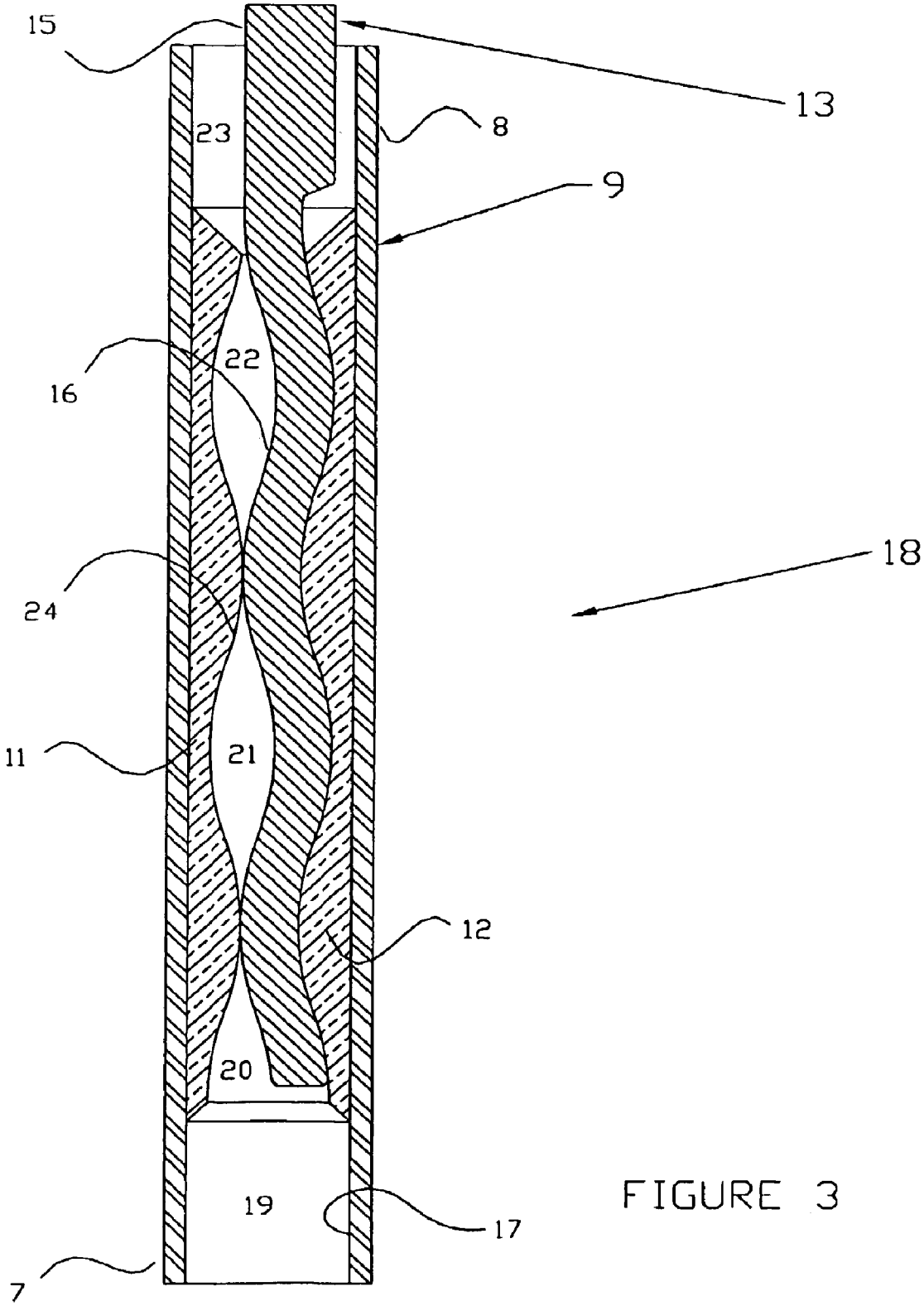
FIG. 3 is a longitudinal cross-sectional view of a conventional progressive cavity pump/motor incorporating a rotor.

FIG. 3 illustrates a conventional technology progressive cavity motor 18, which alternatively could be a progressive cavity pump. To transmit the power developed inside the motor 18 to the adjoining systems, the rotor 13 includes a lower connection section 15. This rotor connecting section 15 may incorporate mechanical connections to allow the rotor 13 to be fixed to the adjoining system, thereby forming a complete drilling tool for rotating a bit in a well.

During operation in a hydrocarbon recovery well, drilling fluid is pumped down to the motor 18, and enters the first end 19 of the motor 18. When the bit encounters rotational resistance, which in turn is transmitted through mechanical connections to the motor. High fluid pressure in the cavities 20, 21 and 22 formed between the rotor 13 and the stator 9 develops in response to the torque demands of the bit. The exact number of cavities will vary depending on the desired operating performance desired the pump/motor. Fluid pressure inside these cavities reacts against the rotor surface 16 and the stator surface 24, causing the rotor 13 to turn inside the stator 9. To transmit the power developed inside the motor 18 to the adjoining systems, the rotor 13 includes a lower connecting section 15. This rotor connecting section 15 may incorporate mechanical connections to allow the rotor 13 to be fixed to the adjoining system, thereby forming a complete drilling tool for rotating a bit in a well. A progressive cavity pump works inversely of the motor described above.

Figure 4:
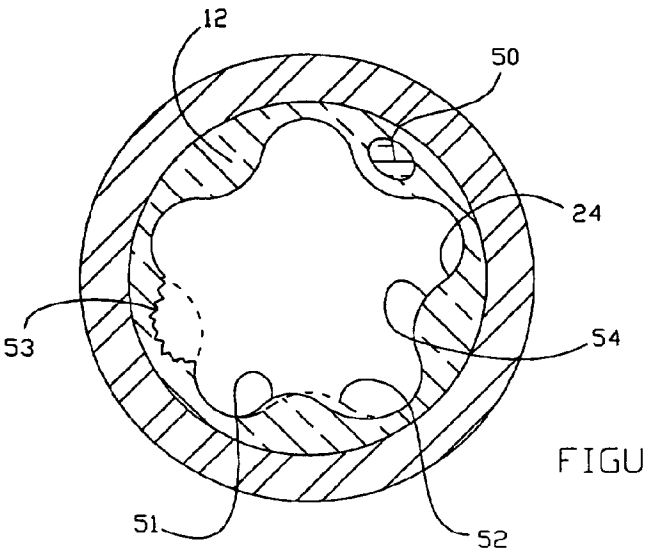
FIG. 4 is a transverse cross-sectional view of a conventional stator illustrating various failures.

FIG. 4 illustrates some of the typical failures experienced by a conventional stator. Due to heat generation in the center of the lobes 12, hard nodules or regions 50 can develop. These nodules 50 occur as a result of the further cross-linking of the elastomer molecules and have inferior mechanical properties compared to the normal elastomer. With high stress being applied to the lobes 12 during operation, the lobes 12 have a tendency to deflect or shift to a new position 51 from their original desired position 52. This shift in position negatively effects performance of the motor or pump. If the stress of operation reaches a substantially high level failure or chunking 53 of the lobe 12 can occur. As understood by those skilled in the art the reinforcement rendered by the profile tube or insert as illustrated in FIGS. 5 and 6 address these shortcomings and will reduce the occurrence of these failures.

Figure 5:
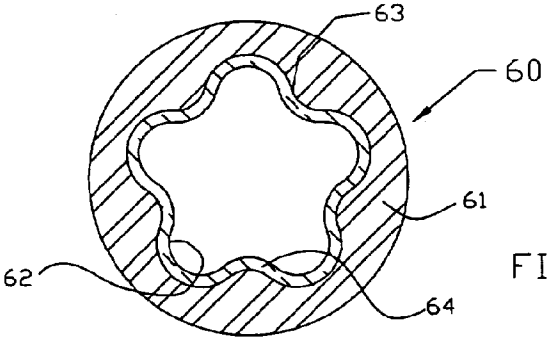
FIG. 5 is a transverse cross-sectional view of an even rubber thickness progressive cavity stator according to the present invention.

FIG. 5 illustrates a substantially even rubber or elastomeric thickness stator 60. The layer 65 of rubber or elastomer is molded in a substantially even layer of uniform thickness on a stator tube or housing 61 with a varying radial thickness. The stator tube 61 has an inner profile 62, which substantially matches the inner profile 63 of the stator 60. Matching the inner tube profile mechanically strengthens the stator lobes 64, allowing them to resist the bending or deflecting forces discussed above. The uniform or even layer 65 of elastomer also allows any heat generated during operation to be effectively conducted away by the high thermal conductivity of the stator tube 61. This uniform rubber thickness layer also maintains the desired geometrical relationship of the profiles 62, 63.

Figure 6:
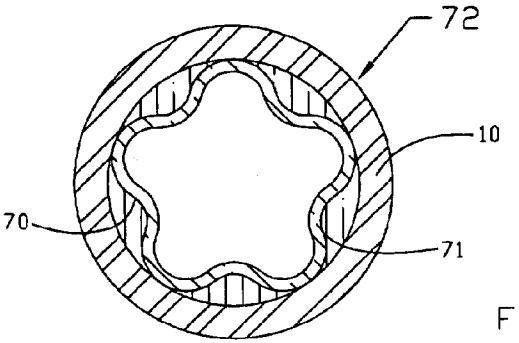
FIG. 6 is a transverse cross-sectional view of an alternate embodiment of an even rubber thickness progressive cavity stator, illustrating a cast in place insert creating the internal profile.
Figure 7:
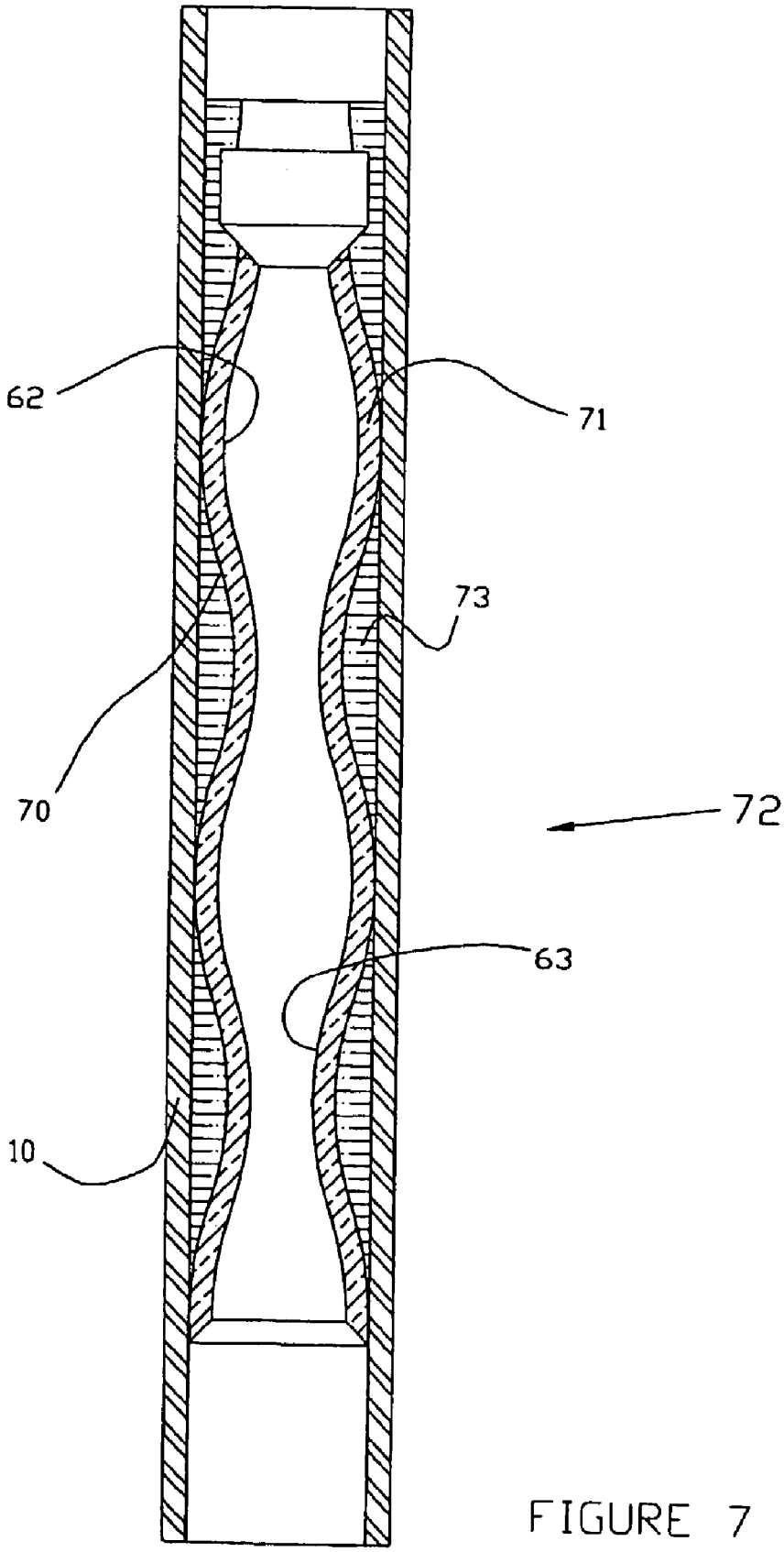
FIG. 7 is a longitudinal cross-sectional view of another embodiment of an even rubber thickness progressive cavity stator, illustrating a cast in place insert creating the internal profile, and a profiled elastomer layer.

Referring to FIG. 6, an alternative embodiment to having the stator tube constructed from a unitary material tube is to have the inner profile 70 of the tube 10 cast or molded inside a conventional steel tube with a substantially uniform wall thickness. The inner cast profile 70 may be manufactured from material with the strength necessary to physically support the even thickness rubber lining 71. The molded or cast in profile may also be manufactured from a highly thermal conductive material to effectively conduct heat generated at the stator/rotor interface. In a downhole drilling motor application, this heat in turn may be conducted to the drilling fluid exterior of the stator tube. FIG. 7 illustrates a longitudinal cross-sectional view of the stator shown in FIG. 6. As illustrated, the rubber layer 71 maintains a substantially even radial thickness over the length of the stator. FIG. 7 also depicts a profiled reinforcement layer 73 mounted to the interior of the cylindrical stator tube 10. Reinforcement layer 73 preferably has a profile substantially similar to but radially slightly larger than that of the elastomeric lining. The profiled layer 73 may be formed from various materials which enhance the strength of the elastomeric material, including metals or fibers.

Figure 8:
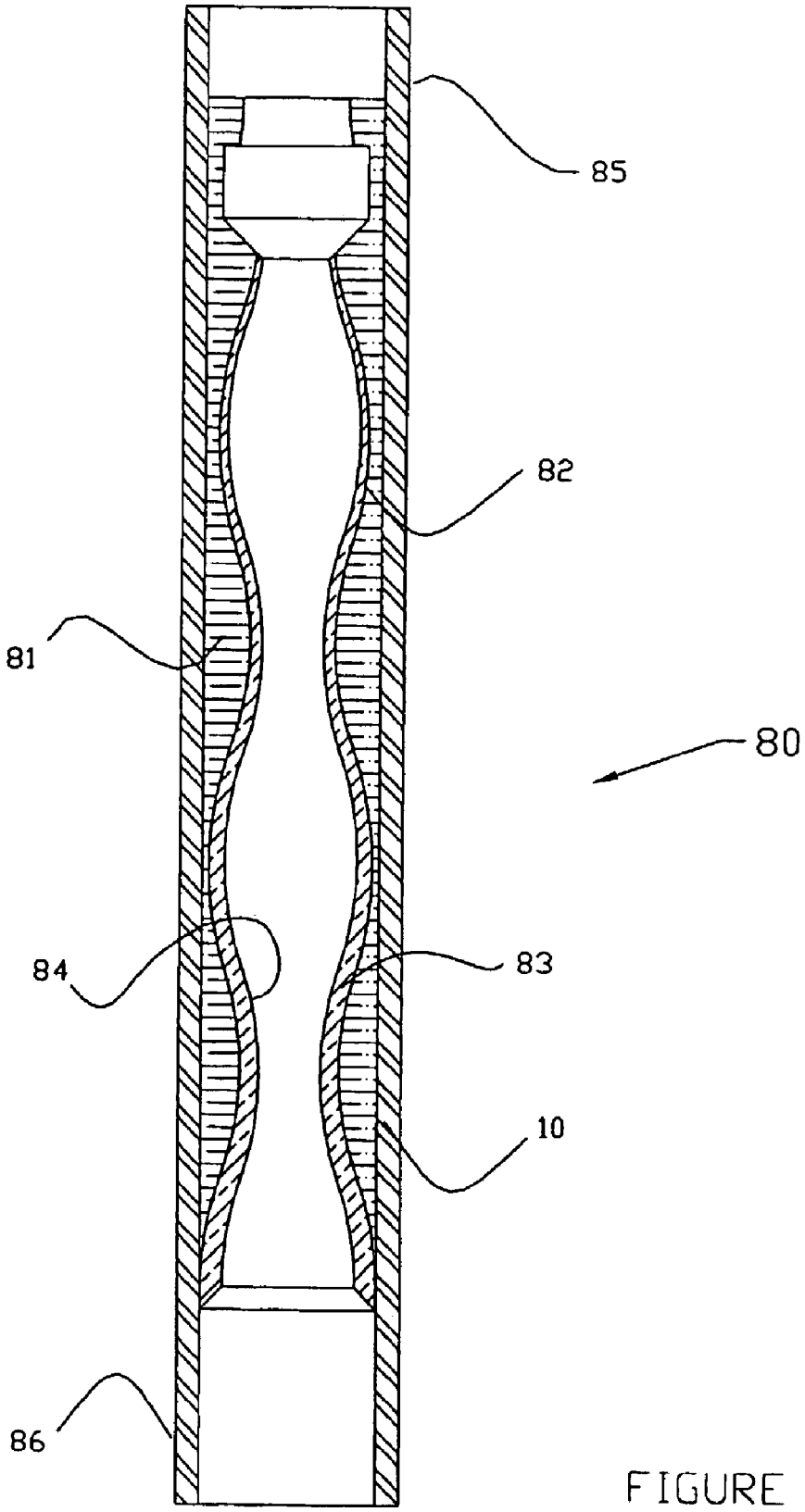
FIG. 8 is a longitudinal cross-sectional view of yet another embodiment of an even rubber thickness progressive cavity stator, illustrating a cast in place insert creating a tapered internal profile resulting in a longitudinally varying elastomer thickness.
Figure 9:
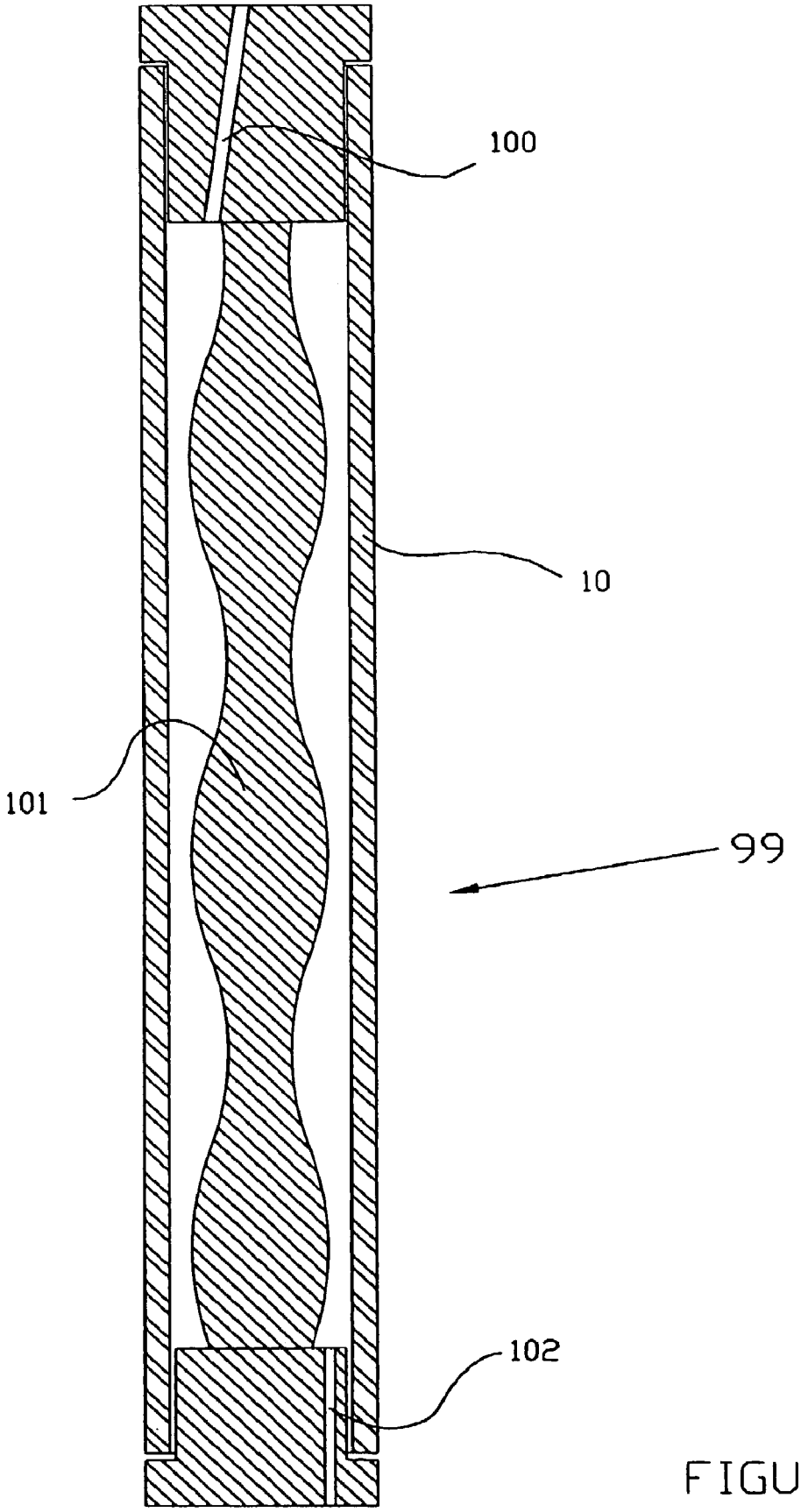
FIG. 9 is a longitudinal cross-sectional view of a conventional progressive cavity stator mold.

An alternative embodiment stator is illustrated in FIG. 8. A substantially uniform thickness stator tube 10 has the inner stator member 81 cast or molded into the stator tube, with the inner stator member 81 having an inner surface profile 82 similar to profile 70. In a preferred embodiment, the inner stator member 81 may be cast with a slight taper between the upper or first end 85 of the stator and opposite lower or second end 86 of the stator. An inner stator member with identical geometry may be manufactured from an integral piece of steel or similar material, then lowered in place within the tube 10.

Figure 14:
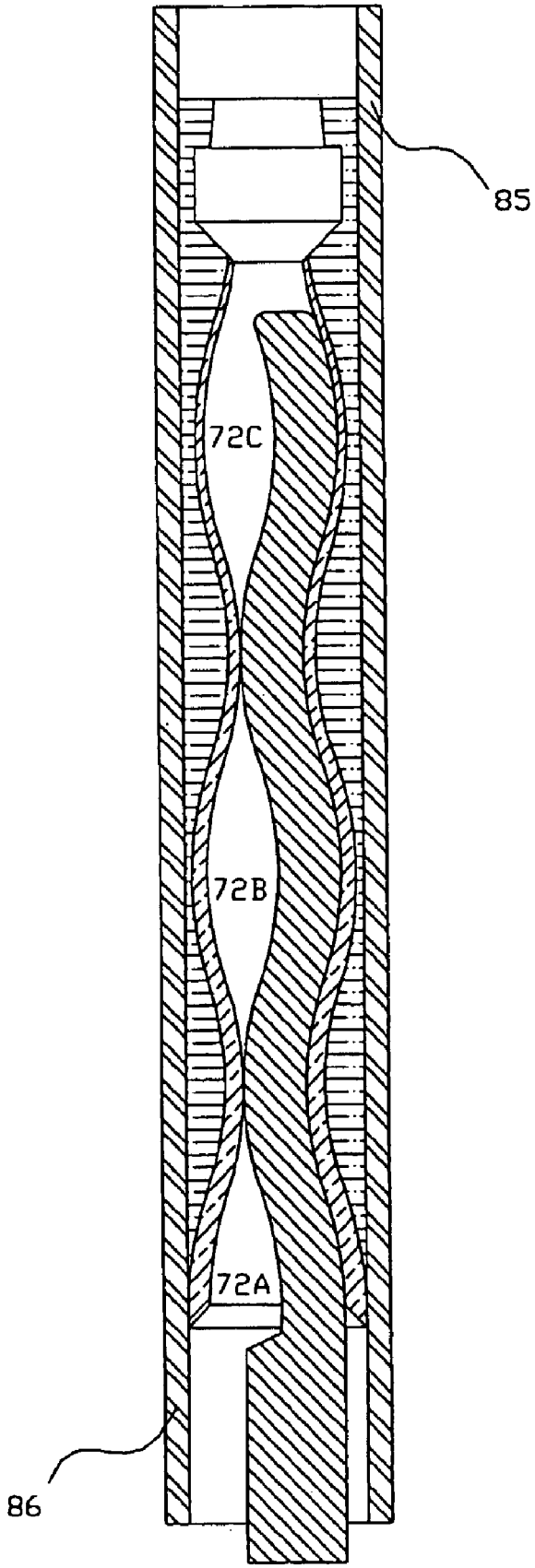
FIG. 14 is a longitudinal cross-sectional view of an cast in place insert stator with a tapered insert creating a longitudinally varying elastomer thickness with the addition of a rotor.

FIG. 14 illustrates the stator of FIG. 8 with the addition of a rotor. The differential pressure existing between the different motor cavities in the pump/motor is not constant over the length of the stator. The pressure differential existing between the cavities 72A and 72B at the first lower end of the stator are generally higher than the pressure differentials existing between the cavities 72B and 72C at the second upper end of the stator. By increasing the thickness of the rubber profile as one moves toward the first lower end of the stator, the elastomeric deflection resulting from the pressure will be greater. This slight increase in deflection towards the first end of the stator will tend to reduce the pressure differential existing near the bottom of the stator, thereby ensuring an even distribution of pressure in the various cavities 72A, B, C, etc., over the length of the stator. An even distribution of pressure over the length of the stator also assures a more even wear and stress to the rubber layer, and therefore maximizes the life of the rubber layer.

Figure 11:
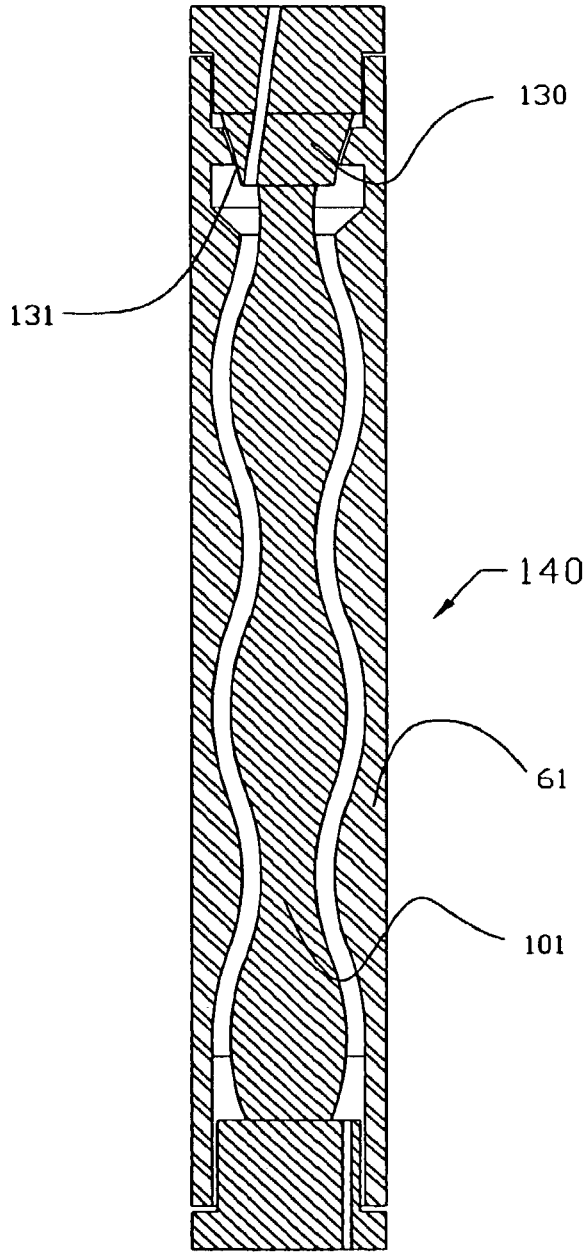
FIG. 11 is a longitudinal cross-sectional view of a conventional progressive cavity stator mold assembly incorporating the alignment modifications of the present invention.
Figure 12:
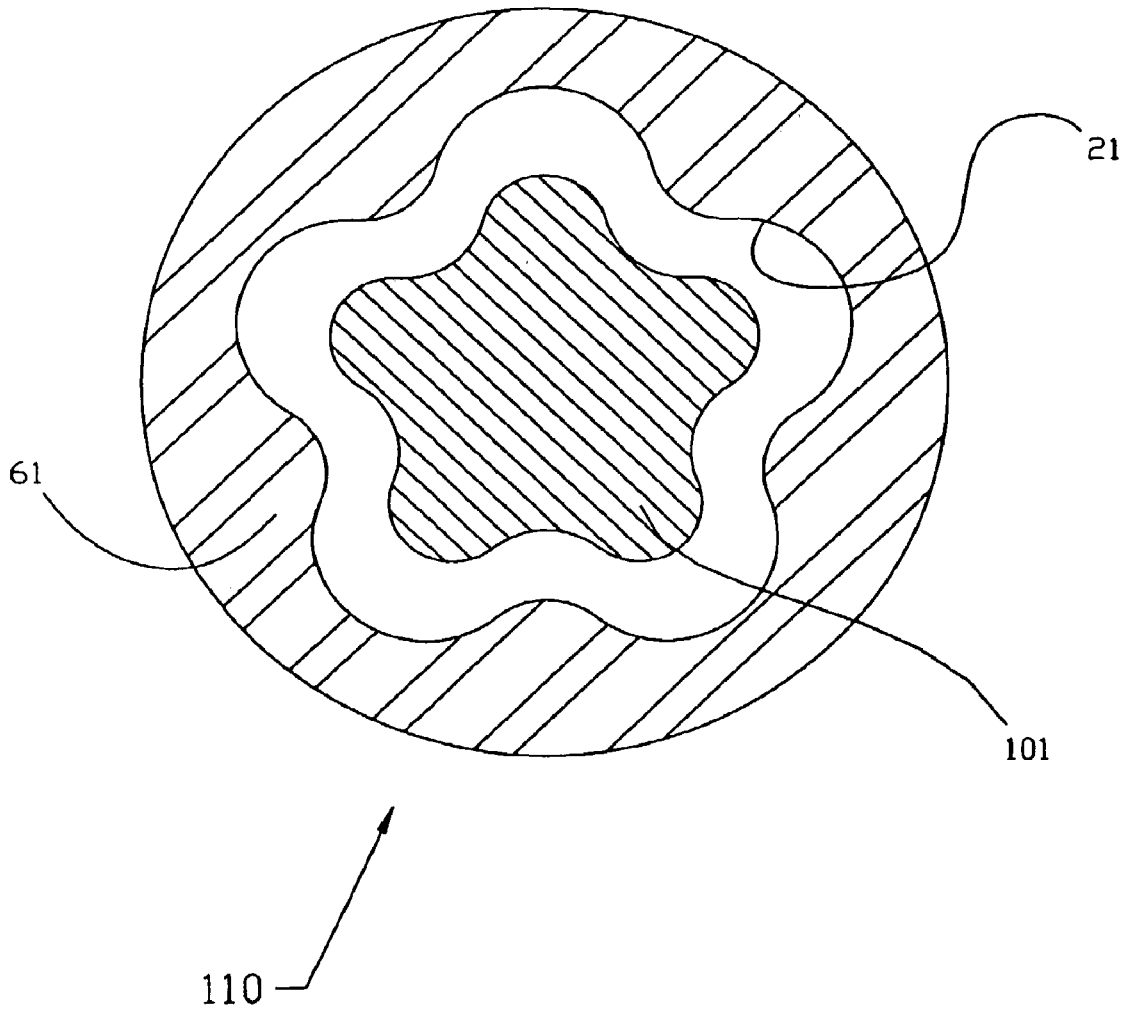
FIG. 12 is a cross-sectional view of an even elastomer thickness progressive cavity stator mold.

FIG. 11 illustrates a cross-sectional view of an improved stator mold assembly 140 in which the rubber or elastomeric lining is of a uniform thickness. To mold this uniform thickness of rubber in the stator tube 61, the core 101 is held rotationally aligned with the shaped stator tube 61. During the process of injecting the elastomer into stator mold assembly 140, the uncured rubber tends to force the stator tube 61 to rotate relative to the core 101.

Figure 10:
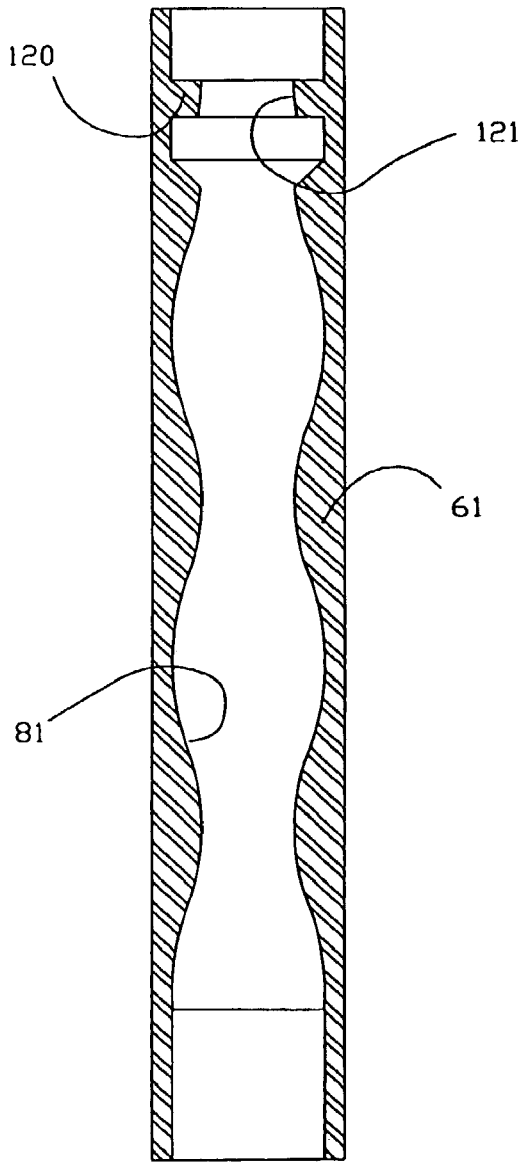
FIG. 10 is a longitudinal cross-sectional view of an even elastomer thickness stator tube incorporating an alignment feature.

The present invention preferably restrains the shaped stator tube 61 from rotating relative to the core 101 during injection of the rubber layer. As illustrated in FIG. 10, the shaped stator tube 61 has an area of contour 120 with an internal profile 121 identical in shape to the shape of stator tube profile 81. As illustrated in FIG. 11, the core has an external profiled alignment key 130. The externally profiled alignment key 130 has an external profile 131 substantially similar to that of the stator tube alignment profile 120. When the stator mold 140 is assembled, the alignment key 130 engages the stator alignment profile 120, thereby restraining the shaped stator tube 61 rotationally about the longitudinal axis of the core 101. After assembly, the mold 140 may be injected in a conventional manner known to those skilled in the art.

Figure 13:
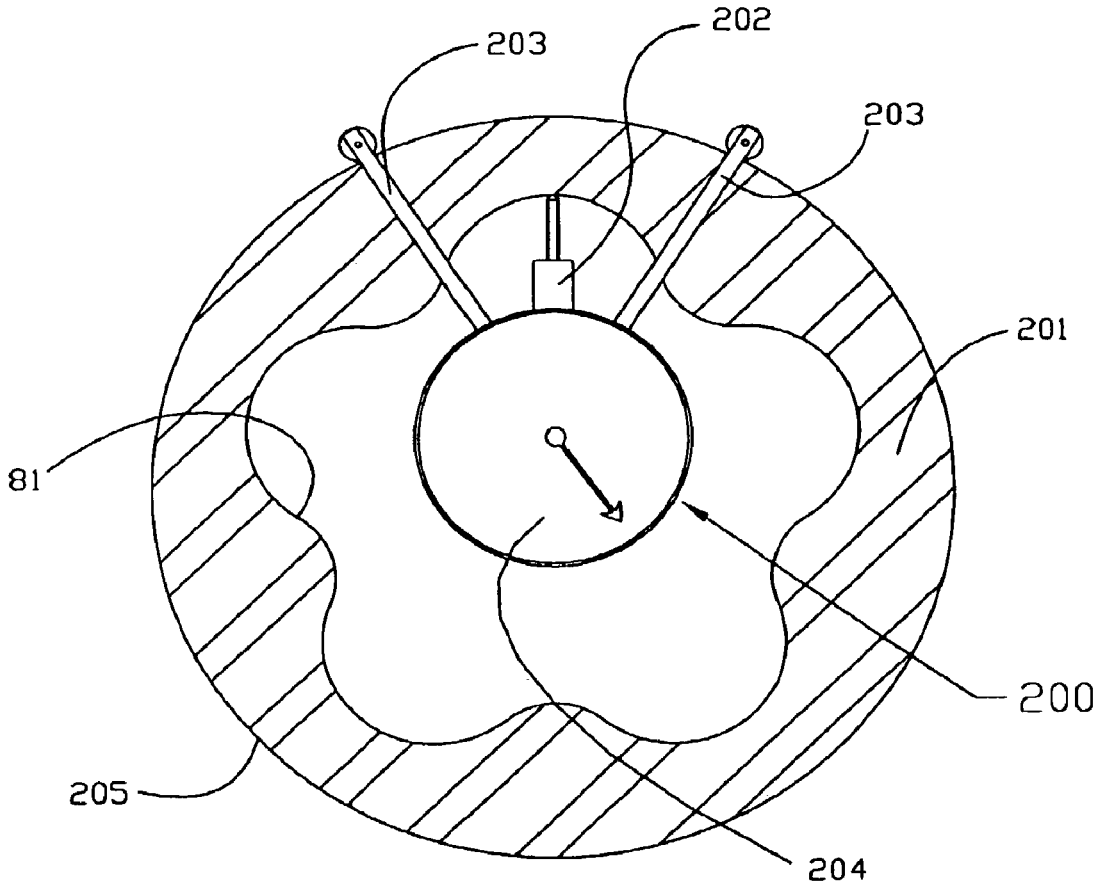
FIG. 13 is a transverse cross-sectional view of an even rubber thickness progressive cavity stator tube illustrating a lead measurement tool.

FIG. 13 is a cross-sectional view of an embodiment of the stator tube lead measurement tool 200 positioned in a section of an even rubber thickness stator tube 201. In a preferred embodiment, lead measurement tool 200 includes a measurement device 202, such that the relative thickness between the outside diameter 205 and the inner profile surface 81 of the stator tube 201 may be determined. One or more stabilizing supports 203 may be present to maintain the measurement tool 200 in alignment with the stator tube 201. As the lead measurement tool 200 is rotated relative to the centerline of the stator tube 201, the varying relative tube thicknesses may be displayed on indicator dial 204. Once a minimum or maximum extreme of the thickness is determined, the angular position of the tool may be recorded. Angular position may be determined with conventional devices, such as protractors and levels. This procedure may then be repeated on the opposite end of the stator tube 61. With the angular positions from each end determined and the length of the stator tube 61 known, the lead or pitch of the spiraling contour may be mathematically determined.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A stator of a pump/motor for either pumping fluid by rotating a rotor or rotating the rotor in response to pumped fluid, a rotor having an exterior profile and rotatable within the stator with a plurality of axially moving chambers between the exterior profile on the rotor and the interior profile on the stator, the stator comprising:

an outer housing having an interior surface defining an interior profile;

an elastomeric layer supported on the outer housing to form an elastomeric layer interior profile; and the stator including an internal profile at one end thereof for rotationally aligning a mold within the stator when molding the elastomeric layer.

2. A stator as defined in claim 1, wherein the elastomeric layer has an increasing thickness extending axially through the stator, such that a radial thickness of one end of the elastomeric layer is less than a radial thickness of the opposing end of the elastomeric layer.

3. A stator as defined in claim 1, wherein the inner profile on the outer housing has a varying radial thickness with respect to a generally cylindrical outer surface of the outer housing, such that the radial thickness of an upper end of the elastomeric layer is less than a radial thickness of a lower end of the elastomeric layer.

4. A stator as defined in claim 1, wherein the elastomeric layer has a substantially uniform thickness along its axial length.

5. A stator of a pump/motor for either pumping fluid by rotating a rotor or rotating the rotor in response to pumped fluid, a rotor having an exterior profile and rotatable within the stator with a plurality of axially moving chambers between the exterior profile on the rotor and the interior profile on the stator, the stator comprising:

an outer housing;

an insert member having an interior surface defining an interior profile and an exterior profile for securing the insert member to the outer housing for securing the interior profile with respect to the outer housing;

an elastomeric layer supported on the outer housing to form an elastomeric layer interior profile;

an exterior profile surface on the insert member and a mating interior surface of the outer housing; and the insert member including an internal profile at one end thereof for rotationally aligning a mold within the insert member when molding the elastomeric layer.

6. A stator as defined in claim 5, wherein the elastomeric layer has an increasing thickness extending axially through the stator, such that a radial thickness of one end of the elastomeric layer is less than a radial thickness of the opposing end of the elastomeric layer.

7. A stator as defined in claim 6, wherein the inner profile secured to the outer housing has a varying radial thickness with respect to a generally cylindrical outer surface of the outer housing, such that the radial thickness of an upper end of the elastomeric layer is less than a radial thickness of a lower end of the elastomeric layer.

8. A stator as defined in claim 7, wherein the exterior profile surface on an insert member has a taper for mating with a tapered interior surface on the outer housing.

9. A stator as defined in claim 8, wherein the tapered surface extends between an upper end of the interior profile and a lower end of the interior profile.

10. A stator as defined in claim 8, wherein the insert member includes an interior profile taper along its length, and the thickness of the elastomeric layer changes as a function of the interior profile taper.

11. A pump/motor for either pumping fluid by rotating a drive shaft or rotating an output stator by pumping fluid, the pump/motor comprising:

a stator having an interior surface defining an interior profile;

an elastomeric layer supported on the stator to form an elastomeric layer interior profile;

a rotor having an exterior profile to correspond with the interior profile of the elastomeric layer and rotatable within the stator with a plurality of axially moving chambers between the exterior profile on the rotor and the interior profile on the elastomeric layer; and the stator including an internal profile at one end thereof for rotationally aligning a mold within the stator when molding the elastomeric layer.

12. A pump/motor as defined in claim 11, wherein the elastomeric layer has an increasing thickness extending axially through the stator, such that a radial thickness of one end of the elastomeric layer is less than a radial thickness of the opposing end of the elastomeric layer.

13. A pump/motor as defined in claim 11, wherein the inner profile on the stator has a varying radial thickness with respect to a generally cylindrical outer surface of the outer housing, such that the radial thickness of an upper end of the elastomeric layer is less than a radial thickness of a lower end of the elastomeric layer.

14. A pump/motor as defined in claim 11, wherein the elastomeric layer has a substantially uniform thickness along its axial length.

15. A pump/motor for either pumping fluid by rotating a drive shaft or rotating an output stator by pumping fluid, the pump/motor comprising:

a stator including an outer housing; and an insert member having an interior surface defining an interior profile and an exterior profile for securing the insert member to the outer housing;

an elastomeric layer supported on the insert member to form an elastomeric layer interior profile;

an exterior profile surface on the insert member and a mating interior surface of the outer housing;

a rotor having an exterior profile to correspond with the interior profile of the elastomeric layer and rotatable within the stator with a plurality of axially moving chambers between the exterior profile on the rotor and the interior profile on the elastomeric layer; and the stator including an internal profile at one end thereof for rotationally aligning a mold within the stator when molding the elastomeric layer.

16. A pump/motor as defined in claim 15, wherein the elastomeric layer has an increasing thickness extending axially through the stator, such that a radial thickness of one end of the elastomeric layer is less than a radial thickness of the opposing end of the elastomeric layer.

17. A pump/motor as defined in claim 15, wherein the inner profile secured to the outer housing has a varying radial thickness with respect to a generally cylindrical outer surface of the outer housing, such that the radial thickness of an upper end of the elastomeric layer is less than a radial thickness of a lower end of the elastomeric layer.

18. A pump/motor as defined in claim 15, wherein the elastomeric layer has a substantially uniform thickness along its axial length.

19. A pump/motor as defined in claim 15, wherein the insert member includes an interior profile taper along its length, and the thickness of the elastomeric layer changes as a function of the interior profile taper.

20. A pump/motor as defined in claim 18, wherein the elastomeric layer has a substantially uniform thickness along its axial length.

* * * * *

UNITED STATES PATENT AND TRADEMARK OFFICE

CERTIFICATE OF CORRECTION

PATENT NO. : 6,881,045 B2
DATED : April 19, 2005
INVENTOR(S) : Zitka et al.

It is certified that error appears in the above-identified patent and that said Letters Patent is hereby corrected as shown below:

Column 8,
Line 29, change "housing;" to -- housing --.

Signed and Sealed this

Twenty-eighth Day of June, 2005

JON W. DUDAS
*Director of the United States Patent and Trademark Office*